United States Patent [19]

Eckenrod et al.

[11] Patent Number: 4,613,367

[45] Date of Patent: Sep. 23, 1986

[54] LOW CARBON PLUS NITROGEN, FREE-MACHINING AUSTENITIC STAINLESS STEEL

[75] Inventors: John J. Eckenrod, Coraopolis; Kenneth E. Pinnow, Pittsburgh; Geoffrey O. Rhodes, Sewickley, all of Pa.; William E. Royer, Lafayette, N.Y.

[73] Assignee: Crucible Materials Corporation, Pittsburgh, Pa.

[21] Appl. No.: 744,627

[22] Filed: Jun. 14, 1985

[51] Int. Cl.[4] ..... C22C 38/58

[52] U.S. Cl. ..... 420/42

[58] Field of Search ..... 75/128 P, 128 N, 128 A

[56] References Cited

U.S. PATENT DOCUMENTS 3,437,478 4/1969 Moskowitz et al. ..... 75/128 P
3,888,659 6/1975 Ferree, Jr. ..... 75/128 P
3,902,898 9/1975 Denhard, Jr. et al. ..... 75/128 P
4,444,588 4/1984 Ney ..... 75/128 P

OTHER PUBLICATIONS

The Making, Shaping and Treating of Steel, United States Steel, Ninth Edition, p. 1282.

*Primary Examiner*—L. Dewayne Rutledge
*Assistant Examiner*—Deborah Yee
*Attorney, Agent, or Firm*—Finnegan, Henderson, Farabow, Garrett & Dunner

[57] ABSTRACT

A chromium-nickel austenitic stainless steel having improved machinability resulting from low carbon and nitrogen contents, along with a high manganese to sulfur ratio. The composition of the steel consists essentially of, in weight percent, carbon plus nitrogen up to 0.060, preferably up to 0.049, and most preferred up to 0.032, chromium 16 to 30, preferred 17 to 19, nickel 5 to 26, preferred 6 to 14, sulfur 0.25 to 0.45, manganese over 2 to about 7 and at least about eight times the sulfur content, balance iron and incidental impurities.

9 Claims, No Drawings

LOW CARBON PLUS NITROGEN, FREE-MACHINING AUSTENITIC STAINLESS STEEL

BACKGROUND OF THE INVENTION

The present invention relates to a chromium-nickel austenitic stainless steel having improved free-machining characteristics. Austenitic stainless steels, and specifically AISI Type 303 austenitic stainless steel, are used in a variety of fabricating and finishing operations. Consequently, machinability of the steel is an important characteristic.

It is known that elements such as sulfur, selenium, tellurium, lead and phosphorus when added to austenitic stainless steels result in improved machinability. It is also known that by maintaining relatively high manganese to sulfur ratios in austenitic stainless steels, including Type 303, machinability may be further enhanced. Improved machinability results with high manganese to sulfur ratios by the formation of relatively soft manganese sulfides. The extent to which machinability may be improved by the addition of manganese and sulfur is limited because at sulfur contents in excess of about 0.45% the corrosion resistance is adversely affected and in addition poor surface finish may result.

SUMMARY OF THE INVENTION

It is accordingly a primary object of the present invention to provide an austentic stainless steel having improved machinability characteristics exceeding those attained by the use of manganese and sulfur at levels conventionally employed for this purpose.

It is a more specific object of the invention to provide an austentic stainless steel wherein carbon and nitrogen, in combination, are maintained at much lower than conventional levels, which in combination with manganese and sulfur additions result in improved machinability.

DETAILED DESCRIPTION OF THE INVENTION

Broadly, in accordance with the invention, the machinability of an austenitic stainless steel is improved by employing very low carbon plus nitrogen contents in combination with manganese and sulfur additions. It is to be understood that for purposes of further improvement in machinability that the known elements conventionally used for this purpose, which in addition to sulfur includes selenium, tellurium, lead and phosphorus, may be employed. The free-machining, austenitic stainless steel of the invention consists essentially of, in weight percent, carbon plus nitrogen up to 0.060, preferably up to 0.049, more preferably up to 0.032; chromium 16 to 30, preferably 17 to 19; nickel 5 to 26, preferably 6 to 14, more preferably 6.5 to 10; sulfur 0.25 to 0.45; manganese over 2 to about 7 and being at least about eight times the sulfur content; silicon up to about 1; phosphorus up to about 0.50; molybdenum up to about 0.60; balance iron and incidential impurities.

EXAMPLES

To demonstrate the invention, and specifically the upper limit of carbon plus nitrogen content, eleven 50-pound heats of austentic stainless steel were melted to the following compositions in percent by weight listed in Table I.

TABLE I

| Heat Number | Chemical Composition - Weight Percent | | | | | | | | | |
|---|---|---|---|---|---|---|---|---|---|---|
| | C | Mn | P | S | Si | Ni | Cr | Mo | N | C + N |
| 1V360 | 0.044 | 3.05 | 0.029 | 0.31 | 0.66 | 8.63 | 17.56 | 0.35 | 0.005 | 0.049 |
| 1V360A | 0.023 | 3.09 | 0.031 | 0.29 | 0.63 | 8.73 | 17.59 | 0.34 | 0.044 | 0.067 |
| 1V366 | 0.023 | 3.06 | 0.031 | 0.30 | 0.64 | 8.61 | 17.60 | 0.35 | 0.075 | 0.098 |
| 1V366A | 0.024 | 3.05 | 0.031 | 0.29 | 0.64 | 8.53 | 17.47 | 0.35 | 0.120 | 0.144 |
| 1V367 | 0.054 | 3.12 | 0.029 | 0.29 | 0.64 | 8.42 | 17.63 | 0.35 | 0.044 | 0.098 |
| 1V368 | 0.054 | 3.09 | 0.030 | 0.29 | 0.63 | 8.61 | 17.77 | 0.35 | 0.065 | 0.119 |
| 1V370 | 0.105 | 3.10 | 0.030 | 0.30 | 0.65 | 8.65 | 17.60 | 0.35 | 0.028 | 0.133 |
| 1V371 | 0.105 | 3.10 | 0.028 | 0.30 | 0.68 | 8.64 | 17.48 | 0.35 | 0.067 | 0.172 |
| 1V372 | 0.110 | 3.07 | 0.030 | 0.30 | 0.68 | 8.56 | 17.54 | 0.36 | 0.120 | 0.230 |
| 1V395 | 0.018 | 3.07 | 0.031 | 0.30 | 0.63 | 8.67 | 17.52 | 0.35 | 0.014 | 0.032 |
| 1V396 | 0.048 | 3.10 | 0.027 | 0.30 | 0.65 | 8.60 | 17.60 | 0.35 | 0.025 | 0.073 |

The compositions listed on Table I have the carbon and nitrogen contents within the ranges of 0.018 to 0.110% carbon and 0.005 to 0.120% nitrogen. From the heats listed in Table I, ingots thereof were forged to 1-3/16 inch hexagonal bars. The bars were solution annealed at 1950 F for one hour, water quenched, turned on a lathe to 1-inch round bars and finely ground using 240 grit silicon carbide paper. The bars underwent lathe tool-life testing to establish the effect of carbon plus nitrogen contents on the machinability of the steels.

In the lathe tool-life test, the number of wafer cuts made on the steel before catastrophic tool failure at various machining speeds is used to provide a measure of machinability. The greater the number of wafers cut, the better the machinability. The specific test conditions were as follows: material being cut was 1-inch diameter bar; the cutoff tools were ¼ inch flat AISI M2 high speed steel; the tool geometry was 7° top rake angle, 7° front clearance angle, 3° side clearance angle, 0° cutting angle; the feed rate was 0.002 inches per revolution; no lubrication was used. The results of the lathe tool-life testing are set forth on Table II.

TABLE II

| % C + % N | Heat # | Lathe Tool-Life Testing Results: Number of Wafer Cuts, Machining Speed-Surface Feet Per Minute | | | | | | |
|---|---|---|---|---|---|---|---|---|
| | | 170 | 160 | 150 | 140 | 130 | 126 | 120 |
| 0.032 | 1V395 | 5.3[a] | 12 | 28 | | | | |
| 0.049 | 1V360 | 5.5 | 9 | 22 | 41 | | | |
| 0.067 | 1V360A | 2.5 | 6.3 | 12.5 | 22.5 | | | |
| 0.073 | 1V396 | | 5 | 11 | 27 | 43 | | |
| 0.098 | 1V366 | | | 7.5 | 15 | 34 | | |
| 0.098 | 1V367 | | 2 | 7.5 | 18.5 | 26 | | |
| 0.119 | 1V368 | | 1.5 | 4.5 | 12.3 | 22 | | |
| 0.133 | 1V370 | | | 5.3 | 12.4 | 24 | | |
| 0.144 | 1V366A | | | 5 | 15 | 20 | 27 | |
| 0.172 | 1V371 | | | 2.75 | 2.5 | | 21 | 31 |

TABLE II-continued

| % C + % N | Heat # | Lathe Tool-Life Testing Results: Number of Wafer Cuts, Machining Speed-Surface Feet Per Minute 170 | 160 | 150 | 140 | 130 | 126 | 120 |
|---|---|---|---|---|---|---|---|---|
| 0.230 | 1V372 | | | 2.25 | 3.5 | 8 | | 22 |

[a]Values shown are the average number of Wafer cuts made before catastrophic tool failure As may be seen from the data presented in Table II, generally low carbon + nitrogen contents in accordance with the limits of the invention result in substantial improvements in machinability at a machining speed of 150 sfpm. Heat No 1V360A having 0.067% C+N provided 12.5 wafer cuts; whereas, when the percent C+N was reduced below this limit significant improvement resulted. With Heat No. 1V360 having 0.049% C+N, 22 wafer cuts were made which is almost double the wafter cuts achieved at a C+N level of 0.067% for Heat No. 1V360A. At the 0.032% C+N content of Heat No. 1V395, the number of wafer cuts again increased drastically to 28 at the machining speed of 150 sfpm.

What is claimed is:

1. A free-machining, austentic stainless steel consisting of, in weight percent, carbon plus nitrogen both present having a total of up to 0.060
chromium 16 to 30
nickel 5 to 26
sulfur 0.25 to 0.45
manganese over 2 to about 7 and is at least about 8 times the sulfur content
silicon up to about 1
phosphorous up to about 0.50
molybdenum up to about 0.60
iron balance with incidental impurities.

2. The steel of claim 1 having carbon plus nitrogen up to 0.049.

3. The steel of claim 1 having carbon plus nitrogen up to 0.032.

4. A free-machining, austentic stainless steel consisting of, in weight precent, carbon plus nitrogen both present having a total of up to 0.060
chromium 17 to 19
nickel 6 to 14
sulfur 0.25 to 0.45
silicon up to about 1
molybdenum up to about 0.60
manganese from over 2 to about 7 percent and is at least 8 times the sulfur content
iron balance with incidental impurities.

5. The steel of claim 4 having carbon plus nitrogen up to 0.049.

6. The steel of claim 4 having carbon plus nitrogen up to 0.032.

7. The steel of claim 4 having nickel 6.5 to 10.

8. The steel of claim 7 having carbon plus nitrogen up to 0.049.

9. The steel of claim 7 having carbon plus nitrogen up to 0.032.

* * * * *